US011846047B2

(12) United States Patent
Tanaka et al.

(10) Patent No.: US 11,846,047 B2
(45) Date of Patent: Dec. 19, 2023

(54) CLOTH AND PROTECTIVE PRODUCT

(71) Applicant: TEIJIN LIMITED, Osaka (JP)

(72) Inventors: Kengo Tanaka, Osaka (JP); Kenji Iwashita, Osaka (JP); Hiroki Shimada, Osaka (JP); Atsushi Kitamura, Osaka (JP)

(73) Assignee: TEIJIN LIMITED, Osaka (JP)

( * ) Notice: Subject to any disclaimer, the term of this patent is extended or adjusted under 35 U.S.C. 154(b) by 288 days.

(21) Appl. No.: 17/297,845

(22) PCT Filed: Dec. 10, 2019

(86) PCT No.: PCT/JP2019/048238
§ 371 (c)(1),
(2) Date: May 27, 2021

(87) PCT Pub. No.: WO2020/129746
PCT Pub. Date: Jun. 25, 2020

(65) Prior Publication Data

US 2022/0010467 A1 Jan. 13, 2022

(30) Foreign Application Priority Data

Dec. 17, 2018 (JP) ..... 2018-235511

(51) Int. Cl.

| | |
|---|---|
| ***D03D 15/533*** | (2021.01) |
| ***D03D 1/00*** | (2006.01) |
| ***D03D 15/283*** | (2021.01) |
| ***D03D 15/47*** | (2021.01) |
| ***D03D 15/50*** | (2021.01) |
| ***D03D 15/41*** | (2021.01) |
| ***D03D 15/513*** | (2021.01) |

(52) U.S. Cl.
CPC ..... *D03D 1/0058* (2013.01); *D03D 15/283* (2021.01); *D03D 15/41* (2021.01); *D03D 15/47* (2021.01); *D03D 15/50* (2021.01); *D03D 15/513* (2021.01); *D03D 15/533* (2021.01); *D10B 2331/02* (2013.01); *D10B 2401/16* (2013.01); *D10B 2403/0114* (2013.01); *D10B 2501/04* (2013.01)

(58) Field of Classification Search
CPC .... D03D 1/0058; D03D 15/283; D03D 15/41; D03D 15/47; D03D 15/50; D03D 15/513; D03D 15/533; D03D 13/008; D03D 1/0035; D10B 2331/02; D10B 2401/16; D10B 2403/0114; D10B 2501/04; D10B 2331/021; A41D 2500/20; A41D 31/26; D02G 3/441
See application file for complete search history.

(56) References Cited

U.S. PATENT DOCUMENTS

| | | | | | |
|---|---|---|---|---|---|
| 3,475,898 | A * | 11/1969 | Sharkey | C08L 77/00 | 428/374 |
| 3,558,419 | A * | 1/1971 | Okazaki et al. | D01F 8/14 | 428/374 |
| 3,791,911 | A * | 2/1974 | Yaeger | B32B 27/32 | 428/113 |
| 3,803,453 | A * | 4/1974 | Hull | D01F 8/04 | 264/105 |
| 4,548,848 | A * | 10/1985 | Shibata | D03D 13/008 | 26/18.5 |
| 4,612,150 | A * | 9/1986 | De Howitt | D02G 3/441 | 264/105 |
| 7,932,194 | B2 * | 4/2011 | Bader | D03D 15/513 | 139/408 |
| 7,993,499 | B2 * | 8/2011 | Zuber | H01M 8/0234 | 429/491 |
| 9,598,797 | B1 * | 3/2017 | Zhu | D03D 1/0035 | |
| 11,612,047 | B2 * | 3/2023 | Dhurjaty | H05G 1/20 | |
| 2012/0090229 | A1 * | 4/2012 | Toye | B32B 27/12 | 442/52 |
| 2014/0331375 | A1 * | 11/2014 | Howland | A41B 1/08 | 2/2.5 |
| 2017/0176146 | A1 * | 6/2017 | Böhringer | A62B 17/006 | |

(Continued)

FOREIGN PATENT DOCUMENTS

| | | | |
|---|---|---|---|
| CN | 202681349 | U | 1/2013 |
| JP | 2006-516306 | A | 6/2006 |
| JP | 2007-501341 | A | 1/2007 |

(Continued)

OTHER PUBLICATIONS

X. Zhang, Antistatic and conductive textiles, in Woodhead Publishing series in Textiles, Functional Textiles for Improved Performance, Protection and Health, 2011; https://www.sciencedirect.com/science/article/pii/B9781845697235500022; accessed Mar. 5, 2023 (Year: 2011).*

International Search Report for PCT/JP2019/048238 dated Mar. 3, 2020.

Office Action dated Jun. 14, 2022 from the Japan Patent Office in JP Application No. 2020-561330.

International Preliminary Report on Patentability dated Jun. 16, 2021, with Written Opinion in International Application No. PCT/JP2019/048238.

Translation of Written Opinion of the International Searching Authority dated Mar. 3, 2020 in International Application No. PCT/JP2019/048238.

(Continued)

*Primary Examiner* — Robert H Muromoto, Jr.
(74) *Attorney, Agent, or Firm* — Sughrue Mion, PLLC

(57) ABSTRACT

Provided are a cloth and a protective product, which allow for any color appearance and have excellent protection performance against electric arcs. The cloth has a woven fabric structure, wherein a front-surface spun yarn containing an infrared absorber- and/or electrically conductive agent-containing fiber and not containing carbon is located on a front surface, while a back-surface spun yarn containing a carbon-containing fiber is located on a back surface, and the cloth has an ATPV value of 8.0 cal/cm$^2$ or more in Arc Resistance Test ASTM F1959-1999.

5 Claims, No Drawings

(56) References Cited

U.S. PATENT DOCUMENTS

2018/0281737 A1* 10/2018 Houraiya ..... D03D 1/02

FOREIGN PATENT DOCUMENTS

| | | | |
|---|---|---|---|
| JP | 2007-529648 | A | 10/2007 |
| JP | 2007-535415 | A | 12/2007 |
| JP | 2009-503278 | A | 1/2009 |
| JP | 2010-502849 | A | 1/2010 |
| JP | 2011-527734 | A | 11/2011 |
| JP | 2017-007244 | A | 1/2017 |
| JP | 2017-8454 | A | 1/2017 |
| JP | 2018-184686 | A | 11/2018 |
| JP | 2020-026595 | A | 2/2020 |
| WO | 2010/141554 | A1 | 12/2010 |
| WO | 2011/126999 | A1 | 10/2011 |
| WO | 2012/077681 | A1 | 6/2012 |
| WO | 2017/094477 | A1 | 6/2017 |
| WO | 2017/150341 | A1 | 9/2017 |
| WO | 2018/044345 | A1 | 3/2018 |
| WO | 2018/084040 | A1 | 5/2018 |

OTHER PUBLICATIONS

Supplementary European Search Report dated Dec. 17, 2021 in European Application No. 19898664.8.

Notification of Reasons for Refusal dated Nov. 8, 2022 from the Japanese Patent Office in Application No. 2020-561330.

* cited by examiner

CLOTH AND PROTECTIVE PRODUCT

CROSS REFERENCE TO RELATED APPLICATIONS

This application is a National Stage of International Application No. PCT/JP2019/048238 filed Dec. 10, 2019, claiming priority based on Japanese Patent Application No. 2018-235511 filed Dec. 17, 2018.

TECHNICAL FIELD

The present invention relates to a cloth and a protective product, which allow for any color appearance and have excellent protection performance against electric arcs.

BACKGROUND ART

Those who work near electrical equipment and ambulance officers who deal with accidents near electrical equipment are potentially exposed to electric arcs or flash fires. An electric arc is an extremely cataclysmic phenomenon, usually involving thousands of volts and thousands of amperes of electricity. Arcing refers to such a phenomenon that due to a potential difference between two electrodes (i.e., voltage), gas molecules are ionized to form a plasma, and, as a result, electricity flows therein; that is, a current flows in a gas that is usually non-conductive.

For protection from such electric arcs and flash fires, cloths using various flame-retardant fibers have been proposed (see, e.g., PTLs 1 to 12).

However, in the case where a work garment or the like is obtained using such a cloth and worn, although the arc protection performance is high, there has been a problem in that such garments are heavy in weight, making the activities difficult. The ease of activity and the arc protection performance contradict to each other, and a cloth having both of them has not been proposed in the past.

Besides, in addition to the problem with colors described above, in recent years, a high-value-added cloth having further improvements in functions in addition to arc protection performance has also been required.

In addition, as a woven fabric for arc protection, PTL 11 proposes a woven fabric for arc protection, in which an aramid fiber not containing carbon particles and an aramid fiber containing carbon particles are used in each of warp and weft, and arc protection performance and any color appearance are simultaneously achieved. However, the arc protection performance has been insufficient, and its color has also been limited.

In addition, for example, as in PTL 12, for the purpose of improving the comfort, a cloth focusing primarily on breathability has been proposed. However, the arc protection performance has been insufficient.

CITATION LIST

Patent Literature

PTL 1: WO 2011/126999
PTL 2: WO 2010/141554
PTL 3: JP-T-2011-527734 (the term "JP-T" as used herein means a published Japanese translation of a PCT patent application)
PTL 4: JP-T-2009-503278
PTL 5: JP-T-2007-529648
PTL 6: JP-T-2007-535415

PTL 7: JP-T-2007-501341
PTL 8: JP-T-2006-516306
PTL 9: JP-T-2010-502849
PTL 10: WO 2012/077681
PTL 11: U.S. Ser. No. 15/354,208
PTL 12: JP-A-2018-184686

SUMMARY OF INVENTION

Technical Problem

The invention has been accomplished against the above background. An object thereof is to provide a cloth and a protective product, which allow for any color appearance and have excellent protection performance against electric arcs.

Solution to Problem

The present inventors have conducted extensive research to solve the above problems and, as a result, by tailoring the constituent yarns of a cloth, the structure of a cloth, and the like with ingenuity, found a range where a cloth that allows for any color appearance and has excellent protection performance against electric arcs can be obtained. As a result of further extensive research, they have accomplished the invention.

The invention provides a cloth having a woven fabric structure, wherein a front-surface spun yarn containing an infrared absorber- and/or electrically conductive agent-containing fiber and not containing carbon is located on a front surface, while a back-surface spun yarn containing a carbon-containing fiber is located on a back surface, and the cloth has an ATPV value of 8.0 cal/cm$^2$ or more in Arc Resistance Test ASTM F1959-1999. In addition, it is preferable that the front-surface spun yarn is a spun yarn containing a meta-type wholly aromatic polyamide fiber in an amount of 30 to 95 wt %, a para-type wholly aromatic polyamide fiber in an amount of 3 to 40 wt %, and an infrared absorber- and/or electrically conductive agent-containing fiber in an amount of 2 to 30 wt %. In addition, it is preferable that the front-surface spun yarn contains an aromatic polyamide fiber, and the aromatic polyamide fiber and the infrared absorber- and/or electrically conductive agent-containing fiber contain the same dye in each fiber. In addition, it is preferable that the exposure of the back-surface spun yarn on the front surface of the cloth is smaller than the exposure of the front-surface spun yarn on the front surface of the cloth. In addition, it is preferable that the back-surface spun yarn contains carbon in an amount of 0.5 to 50 wt % based on the spun yarn weight. In addition, it is preferable that the back-surface spun yarn includes a carbon-containing meta-type wholly aromatic polyamide fiber and/or para-type wholly aromatic polyamide fiber. In addition, it is preferable that carbon is contained in an amount of more than 3.0 wt % based on the cloth weight. In addition, it is preferable that the front-surface spun yarn contains the infrared absorber-containing fiber in an amount of 10 to 30 wt %. In addition, it is preferable that the front-surface spun yarn contains the electrically conductive agent-containing fiber in an amount of 2 to 20 wt %. In addition, it is preferable that the breathability specified in JIS L 1096:2010, A Method (Frazier Method), is 10 to 100 cc/cm$^2$·sec. In addition, it is preferable that the cover factor (CF) defined by the following CF formula is 1,700 to 3,500. $CF=(DWp/1.1)^{1/2}\times MWp+(DWf/1.1)^{1/2}\times MWf$ [DWp is the warp total fineness (dtex), MWp is the warp weaving density (yarns/2.54 cm), DWf is the weft total fineness (dtex), and MWf is the weft weaving density (yarns/2.54 cm)]. In addition, it is preferable that the weight per unit of the cloth specified in JIS L 1096:2010, A Method, is 120 to 260 g/m$^2$. In addition, it is preferable that the thickness of the cloth specified in JIS L 1096:2010 is 0.4 to 0.8 mm. In addition, it is preferable that the cloth has a multi-layered structure.

In addition, the invention provides a protective product using the above cloth and selected from the group consisting of arc protective garments, flame-proof protective garments, work garments, activity garments, gloves, aprons for protection, and members for protection.

Advantageous Effects of Invention

According to the invention, a cloth and a protective product, which have excellent protection performance against electric arcs, can be obtained.

DESCRIPTION OF EMBODIMENTS

Hereinafter, embodiments of the invention will be described in detail.

The cloth of the invention has a woven fabric structure composed of warp and weft and has a woven fabric structure, wherein a front-surface spun yarn containing an infrared absorber- and/or electrically conductive agent-containing fiber and not containing carbon is located on a front surface, while a back-surface spun yarn containing a carbon-containing fiber is located on a back surface, and the cloth has an ATPV value of 8.0 cal/cm$^2$ or more in Arc Resistance Test ASTM F1959-1999. The ATPV value is more preferably 8.0 to 15.0 cal/cm$^2$.

With respect to the spun yarns, it is preferable that an infrared absorber- and/or electrically conductive agent-containing spun yarn is located on the front surface (preferably used as the atmosphere side) of the cloth (hereinafter referred to as "front-surface spun yarn"), and a spun yarn is located on the back surface (the skin side when worn) of the cloth (hereinafter referred to as "back-surface spun yarn"). In this case, the back-surface spun yarn may be exposed on the front surface of the cloth, but it is preferable that the exposure of the back-surface spun yarn on the front surface of the cloth is smaller than that of the front-surface spun yarn. In other words, the front-surface spun yarn may be exposed on the back surface of the cloth, but it is preferable that the exposure of the front-surface spun yarn on the back surface of the cloth is smaller than that of the back-surface spun yarn. As a result of the above configuration, in addition to excellent protection performance against electric arcs, any color hue is allowed.

Each spun yarn preferably contains a flame-retardant fiber. The front-surface spun yarn preferably contains a meta-type wholly aromatic polyamide fiber and a para-type wholly aromatic polyamide fiber as flame-retardant fibers, and more preferably contains a meta-type wholly aromatic polyamide fiber in an amount of 60 to 87 wt % (more preferably 70 to 85 wt %) based on the spun yarn weight and a para-type wholly aromatic polyamide fiber in an amount of 3 to 10 wt % (more preferably 5 to 10 wt %) based on the spun yarn weight.

The front-surface spun yarn preferably contains an infrared absorber- and/or electrically conductive agent-containing fiber. The weight proportion of an infrared absorber-containing fiber is preferably 10 to 30 wt % (more preferably 10 to 20 wt %) based on the spun yarn weight. When the cloth contains an infrared absorber-containing fiber, in the case where the cloth is used in a garment and involved in an electric arc accident or flash fire, the infrared absorber absorbs the thermal energy of the electric arc or flame flash, whereby the thermal energy that reaches the human body can be suppressed. Conversely, when the weight proportion of the fiber is higher than this range, the weight proportion of flame-retardant fibers decreases, and thus the flame retardancy may decrease. In addition, an electrically conductive agent-containing fiber is preferably in an amount of 2 to 30 wt % (more preferably 5 to 20 wt %, still more preferably 10 to 20 wt %) based on the spun yarn weight.

Incidentally, in the front-surface spun yarn, either of an infrared absorber-containing fiber and an electrically conductive agent-containing fiber may be used alone, and it is also possible that both of them are used. As a preferred example where both an infrared absorber and an electrically conductive agent are used, a core-sheath conjugate fiber in which an infrared absorber is contained in the sheath part, and an electrically conductive agent such as a metal oxide-containing polymer is contained in the core part, can be mentioned. Further, a sheath-core conjugate fiber, an eccentric sheath-core conjugate fiber, and the like, in which the sheath part is made of acrylic, and the core part is made of a polymer containing metal oxide-based particles, are also preferable.

The back-surface spun yarn preferably contains carbon in an amount of 0.5 to 50 wt % (more preferably 0.5 to 25 wt %, still more preferably 0.5 to 10 wt %) based on the spun yarn weight. In addition, the back-surface spun yarn preferably includes a carbon-containing meta-type wholly aromatic polyamide fiber and/or para-type wholly aromatic polyamide fiber.

In addition, carbon is preferably contained in an amount of more than 3.0 wt % based on the cloth weight. When carbon is contained in an amount of more than 3.0 wt % based on the cloth weight, even at a low weight per unit, upon an electric arc accident or flash fire, carbon absorbs the thermal energy of the electric arc or flame flash, whereby the thermal energy that reaches the human body can be suppressed.

In addition, the breathability of the cloth specified in JISJIS L 1096:2010, A Method (Frazier Method), is preferably 10 to 100 cc/cm$^2$·sec (more preferably 10 to 50 cc/cm$^2$·sec). When the breathability is within the above range, the comfort during activity is excellent.

In addition, the cover factor (CF) of the cloth defined by the following formula is preferably 1,700 to 3,500 (more preferably 2,000 to 3,200).

$$CF=(DWp/1.1)^{1/2}\times MWp+(DWf/1.1)^{1/2}\times MWf$$

[DWp is the warp total fineness (dtex), MWp is the warp weaving density (yarns/2.54 cm), DWf is the weft total fineness (dtex), and MWf is the weft weaving density (yarns/2.54 cm).]

When the CF of the cloth is within the above range, in the case where the cloth is used as a garment and involved in an electric arc accident or flash fire, the thermal energy that reaches the human body can be efficiently suppressed.

In addition, the weight per unit of the cloth specified in JIS L 1096:2010, A Method, is preferably 120 to 260 g/m$^2$ (more preferably 150 to 240 g/m$^2$, still more preferably 150 to 190 g/m$^2$). When the weight per unit is smaller than this range, in the case where the cloth is used in a garment and involved in an electric arc accident or flash fire, the suppressing effect on the thermal energy that reaches the human body may be insufficient. Conversely, when the weight per unit is greater than this range, although the effect is sufficient, as a work garment, the wearing comfort or the ease of activity may decrease.

The thickness of the cloth is preferably 0.4 to 0.8 mm (more preferably 0.4 to 0.6 mm). When the thickness is 0.4 mm or less, the durability of the cloth may be insufficient, while when it is 0.8 mm or more, when such a cloth is formed into a garment, the freedom of movement may decrease due to the thickness of the cloth, resulting in a decrease in the ease of activity.

The flame-retardant fiber is preferably a fiber having a limiting oxygen index (LOI) specified in JIS L 1091 (E Method) of 26 or more. For example, a meta-type wholly aromatic polyamide fiber, a para-type wholly aromatic polyamide fiber, a polyparaphenylene benzoxazole fiber, a polybenzimidazole fiber, a polybenzothiazole fiber, a polyimide fiber, a polyetherimide fiber, a polyamideimide fiber, a polysulfoneamide fiber, a polyetheretherketone fiber, a polyarylate fiber, a carbon fiber, a polyphenylene sulfide fiber, a polyvinyl chloride fiber, flame-retardant rayon, a modacrylic fiber, a flame-retardant acrylic fiber, a flame-retardant polyester fiber, a flame-retardant vinylon fiber, a melamine fiber, a phenol fiber, a fluorine fiber, flame-retardant wool, flame-retardant cotton, and the like can be mentioned. These flame-retardant fibers may be used alone, and it is also possible to use two or more kinds.

In addition, as a flame-retardant fiber, in terms of strength and flame retardancy, it is preferable to use a para-type wholly aromatic polyamide fiber, that is, polyparaphenylene terephthalamide or copolyparaphenylene/3,4'-oxydiphenylene terephthalamide, and/or a meta-type wholly aromatic polyamide fiber, that is, polymetaphenylene isophthalamide. Further, it is preferable that a para-type wholly aromatic polyamide fiber and a meta-type wholly aromatic polyamide fiber are blended and used as a spun yarn.

Incidentally, these flame-retardant fibers are preferably used as filaments, commingled yarns, spun yarns, and the like, particularly preferably as spun yarns. Incidentally, each spun yarn may also be a plied yarn obtained by plying several yarns. In addition, in the case of blending with other fibers, short fibers having a fiber length of 25 to 200 mm (more preferably 30 to 150 mm) are preferable. In addition, the single fiber fineness is preferably 1 to 5 dtex. Incidentally, the fiber lengths of fibers may be the same or different from each other.

Incidentally, as long as the object of the invention is not impaired, these flame-retardant fibers may also contain additives such as antioxidants, infrared absorbers, UV absorbers, heat stabilizers, flame retarders, titanium oxide, colorants, and inert fine particles.

In addition, a flame-retardant fiber may also contain other fibers as long as the flame retardancy is not impaired. In this case, as other fibers, polyester fibers, nylon fibers, rayon fibers, polynosic fibers, lyocell fibers, acrylic fibers, acrylic-based fibers, vinylon fibers, cotton, hemp, and wool can be mentioned. These other fibers may be used alone, and it is also possible to use two or more kinds.

Incidentally, as long as the object of the invention is not impaired, these other fibers may also contain additives such as antioxidants, infrared absorbers, UV absorbers, heat stabilizers, flame retarders, titanium oxide, colorants, inert fine particles, and electrically conductive particles.

Incidentally, as long as the effects of the invention are not impaired, the front-surface spun yarn of the invention may also contain functional substances other than infrared absorbers and/or electrically conductive agents, such as UV absorbers and deodorants.

It is necessary that the infrared absorber has an infrared absorption effect. For example, antimony-doped tin oxides, indium tin oxides, niobium-doped tin oxides, phosphorus-doped tin oxides, fluorine-doped tin oxides, antimony-doped tin oxides supported on a titanium oxide substrate, iron-doped titanium oxides, carbon-doped titanium oxides, fluorine-doped titanium oxides, nitrogen-doped titanium oxides, aluminum-doped zinc oxides, antimony-doped zinc oxides, and the like can be mentioned. Incidentally, indium tin oxides include indium-doped tin oxides and tin-doped indium oxides.

It is necessary that the electrically conductive agent has an electrical conduction effect. For example, polymers containing electrically conductive particles, such as metal particles (silver particles, copper particles, aluminum particles, etc.), metal oxides (particles containing a tin(IV) oxide, zinc oxide, indium oxide, or the like as a main component), particles coated with an electrically conductive oxide, and the like can be mentioned.

In addition, a meta-type wholly aromatic polyamide is a fiber made of a polymer wherein 85 mol % or more of its repeating unit is m-phenyleneisophthalamide. The meta-type wholly aromatic polyamide may also be a copolymer containing a third component in an amount of less than 15 mol %.

Such a meta-type wholly aromatic polyamide can be produced by a conventionally known interfacial polymerization method. With respect to the polymerization degree of the polymer, it is preferable to use one having an intrinsic viscosity (I.V.) of 1.3 to 1.9 dl/g as measured with an N-methyl-2-pyrrolidone solution having a concentration of 0.5 g/100 ml.

The meta-type wholly aromatic polyamide may contain an alkylbenzenesulfonic acid onium salt. Preferred examples of alkylbenzenesulfonic acid onium salts include compounds such as a hexylbenzenesulfonic acid tetrabutylphosphonium salt, a hexylbenzenesulfonic acid tributylbenzylphosphonium salt, a dodecylbenzenesulfonic acid tetraphenylphosphonium salt, a dodecylbenzenesulfonic acid tributyltetradecylphosphonium salt, a dodecylbenzenesulfonic acid tetrabutylphosphonium salt, and a dodecylbenzenesulfonic acid tributylbenzylammonium salt. Among them, a dodecylbenzenesulfonic acid tetrabutylphosphonium salt and a dodecylbenzenesulfonic acid tributylbenzylammonium salt are easy to obtain, have excellent thermal stability, also have high solubility in N-methyl-2-pyrrolidone, and thus are particularly preferable.

When the proportion of the alkylbenzenesulfonic acid onium salt contained is 2.5 mol % or more, preferably 3.0 to 7.0 mol %, relative to poly-m-phenyleneisophthalamide, a sufficient improving effect can be obtained on dye affinity.

In addition, as a method for mixing poly-m-phenylene isophthalamide and an alkylbenzenesulfonic acid onium salt, a method in which poly-m-phenylene isophthalamide is mixed and dissolved in a solvent, and an alkylbenzenesulfonic acid onium salt is dissolved in the solvent, is used, for example. Any of such methods may be used. The dope thus obtained is formed into fibers by a conventionally known method.

With respect to the polymer used for a meta-type wholly aromatic polyamide fiber, it is also possible that into an aromatic polyamide backbone having a repeating structural unit represented by the following formula (1), an aromatic diamine component or aromatic dicarboxylic acid halide component that is different from the main structural unit of the repeating structure is copolymerized as a third component to make a proportion of 1 to 10 mol % based on the total amount of the repeating structural units of the aromatic polyamide, thereby improving the dyeing affinity or discoloration/fading resistance.

(NH-Ar1-NH—CO-Ar1-CO)— formula (1)

Here, Ar1 is a divalent aromatic group having a linking group not in the meta-position or not in the axially parallel direction.

In addition, copolymerization as a third component is also possible. As specific examples of aromatic diamines represented by formulae (2) and (3), for example, p-phenylenediamine, chlorophenylenediamine, methylphenylenediamine, acetylphenylenediamine, aminoanisidine, benzidine, bis(aminophenyl)ether, bis(aminophenyl)sulfone, diaminobenzanilide, diaminoazobenzene, and the like can be mentioned. As specific examples of aromatic dicarboxylic acid dichlorides represented by formulae (4) and (5), for example, terephthalic acid chloride, 1,4-naphthalenedicarboxylic acid chloride, 2,6-naphthalenedicarboxylic acid chloride, 4,4'-biphenyldicarboxylic acid chloride, 5-chloroisophthalic acid chloride, 5-methoxyisophthalic acid chloride, bis(chlorocarbonylphenyl) ether, and the like can be mentioned.

$H_2N$-Ar2-$NH_2$ formula (2)

$H_2N$-Ar2-Y-Ar2-NH2 formula (3)

XOC-Ar3-COX formula (4)

XOC-Ar3-Y-Ar3-COX formula (5)

Here, Ar2 is a divalent aromatic group different from Ar1, Ar3 is a divalent aromatic group different from Ar1, Y is at least one atom or functional group selected from the group consisting of an oxygen atom, a sulfur atom, and an alkylene group, and X is a halogen atom.

In addition, when the crystallinity of the meta-type wholly aromatic polyamide fiber is 5 to 35%, the dye exhaustion is improved, and the color can be easily adjusted as intended even with a reduced amount of dye or under weak dyeing conditions. Further, when the crystallinity is 15 to 25%, uneven distribution of the dye on the surface is unlikely to occur, and the discoloration/fading resistance is improved, whereby the practically necessary dimensional stability can also be ensured.

In addition, when the residual solvent content of the meta-type wholly aromatic polyamide fiber is 0.1 wt % or less (preferably 0.001 to 0.1 wt %), a decrease in flame retardancy can be suppressed.

The meta-type aromatic polyamide fiber can be produced by the following method. In particular, by the following method, the crystallinity and residual solvent content can be made within the above ranges.

The polymerization method for a meta-type wholly aromatic polyamide polymer does not have to be particularly limited, and it is possible to use, for example, the solution polymerization method or interfacial polymerization method described in JP-B-35-14399, U.S. Pat. No. 3,360,595, JP-B-47-10863, or the like.

The spinning solution is not particularly limited, and it is possible to use an amide-based solvent solution containing an aromatic copolyamide polymer obtained by the solution polymerization or interfacial polymerization described above, for example. Alternatively, it is also possible that the polymer is isolated from the polymerization solution of the solution polymerization, dissolved in an amide-based solvent, and used.

Examples of amide-based solvents used herein include N,N-dimethylformamide, N,N-dimethylacetamide, N-methyl-2-pyrrolidone, and dimethyl sulfoxide, and N,N-dimethylacetamide is particularly preferable.

In the copolymerized aromatic polyamide polymer solution obtained as described above, the alkali metal salt or alkaline earth metal salt is preferably 1 wt % or less, more preferably 0.1 wt % or less, based on the total weight of the polymer solution. As a result, the presence of the alkali metal salt or alkaline earth metal salt leads to further stabilization, making the solution usable at higher concentrations and lower temperatures; therefore, this is preferable.

In a spinning/coagulation step, the spinning solution obtained above (meta-type wholly aromatic polyamide polymer solution) is extruded into a coagulation liquid and coagulated.

The spinning apparatus is not particularly limited, and a conventionally known wet-spinning apparatus can be used. In addition, as long as stable wet-spinning can be performed, there is no need to particularly limit the number of spinning holes of the spinneret, their arrangement, the hole shape, and the like. For example, it is possible to use a multi-hole spinneret for staple fibers, in which the number of holes is 1,000 to 30,000 and the spinning hole diameter is 0.05 to 0.2 mm, or the like.

In addition, it is suitable that the temperature of the spinning solution (meta-type wholly aromatic polyamide polymer solution) upon extrusion from the spinneret is 20 to 90° C.

As a coagulation bath used to obtain a fiber, an aqueous solution containing substantially no inorganic salt and having an amide-based solvent, preferably NMP, concentration of 45 to 60 mass % is used at a bath liquid temperature of 10 to 50° C. An amide-based solvent (preferably NMP) concentration of less than 45 mass % results in a thick-skin structure, whereby the washing efficiency in a washing step decreases, making it difficult to reduce the residual solvent content of the fiber. Meanwhile, in the case where the amide-based solvent (preferably NMP) concentration is more than 60 mass %, uniform coagulation inside the fiber is not achieved, making it difficult, also in this case, to reduce the residual solvent content of the fiber. Incidentally, as the immersion time for the fiber in the coagulation bath, 0.1 to 30 seconds is suitable.

Subsequently, the fiber is drawn to a draw ratio of 3 to 4 in a plastic drawing bath containing an aqueous solution having an amide-based solvent, preferably NMP, concentration of 45 to 60 mass % at a bath liquid temperature of 10 to 50° C. After drawing, the fiber is thoroughly washed with an aqueous solution of 10 to 30° C. having an NMP concentration of 20 to 40 mass % and then through a hot water bath of 50 to 70° C.

The fiber after washing is subjected to a dry-heat treatment at a temperature of 270 to 290° C. As a result, a meta-type wholly aromatic polyamide fiber that satisfies the above crystallinity and residual solvent content can be obtained.

Incidentally, the spun yarn may be made of a cotton mix or obtained by blending. Alternatively, according to the expected functional characteristics, it may also be a coiled spun yarn, a sheath-core two-layered spun yarn, or a composite yarn using a core-spun yarn or a stretch-broken yarn. The spinning method for the spun yarn may be innovative spinning, such as ring spinning, MTS, MJS, or MVS, or an ordinary spinning method, such as ring spinning. The twist direction may be Z-direction or S-direction.

Next, the spun yarn is twist set as necessary (vacuum steam setting), and then two or more of such spun yarns (preferably two to four yarns, particularly preferably two yarns) are aligned, combined, and plied. Examples of twisting machines used for plying include twisting machines such as an up-twister, a covering machine, an Italian twisting machine, and a double twister.

Next, the plied yarn is twist set (the same high-pressure vacuum steam setting as used for twist setting conventional aramid double-ply yarns). In the case where firm twist setting has to be imparted, the number of times of twist setting may be increased, or the twist setting temperature or setting time may be changed. For example, the setting temperature may be 115 to 125° C., the setting time may be 20 to 40 minutes, and the number of times may be 1 to 3. A higher setting temperature or a longer setting time results in better setting properties and thus is more preferable. The setting properties can be further enhanced by increasing the number of times of twist setting, prolonging the treatment time, or raising the temperature. Considering the production management (the safety of work management, quality management, etc.) and the production/processing cost, it is preferable to prolong the treatment time. In addition, a higher degree of vacuum results in improved quality and thus is more preferable.

Examples of woven fabric structures include three foundation weaves such as twill weave and satin weave, modified weaves, modified weaves such as modified twill weave, and one-side backed weaves such as warp backed weave and weft backed weave. Incidentally, a woven fabric having such a woven fabric structure can be woven by an ordinary method using an ordinary weaving machine such as a rapier loom or an air-jet weaving machine. The woven fabric may be mono-layered, or may also have a multi-layered structure including two or more layers.

In addition, the weaving of the woven fabric is preferably followed by post-processing. Specific examples of post-processing steps include scouring, drying, relaxing, singeing, dyeing, and functionalization treatments. The scouring or relaxing treatment may be an open-width treatment or may also be a jet scouring/relaxing treatment. A specific example is a method in which the fabric is treated with an open-width non-tension machine during continuous scouring or continuous drying. Such a method uses, for example, a Sofcer scouring machine, drying/fulling, a shrink surfer, a short loop, a Luciole dryer, or the like. In addition, in some cases, the scouring or relaxing step may be omitted.

In addition, for improving other properties, it is also possible to additionally apply shaving and/or singeing, and/or other various function-imparting processes with a sweat absorbent, a water repellent, a heat storage agent, a UV shielding or antistatic agent, an antibacterial agent, a deodorant, an insect repellent, a mosquito repellent, a mosquito repellent, a phosphorescent agent, a retroreflective agent, or the like. Here, as the sweat absorbent, polyethylene glycol diacrylate, a polyethylene glycol diacrylate derivative, a polyethylene terephthalate-polyethylene glycol copolymer, or a water-soluble polyurethane is preferable. Examples of methods for imparting a sweat absorbent to the cloth are a method that performs a padding treatment, a method in which, during dyeing processing, the cloth is treated in the same bath containing a dyeing liquid, and the like.

In the invention, in order to obtain a cloth that allows for any color hue with high-quality appearance, in the case where a meta-type wholly aromatic polyamide fiber and an infrared absorber- and/or electrically conductive agent-containing fiber are contained in the front-surface spun yarn of the cloth, it is preferable that the fibers are both colored. Here, the meta-type wholly aromatic polyamide fiber and the infrared absorber- and/or electrically conductive agent-containing fiber preferably contain the same dye. In particular, the same dye is preferably a cationic dye.

A cationic dye refers to a water-soluble dye soluble in water and having a group that exhibits basicity, and has been widely used in the dyeing of acrylic fibers, natural fibers, or cationic-dyeable polyester fibers. As cationic dyes, for example, diacrylic methane dyes, triacrylic methane dyes, quinoneimine (azine, oxazine, thiazine) dyes, xanthene dyes, methine (polymethine, azamethine) dyes, heterocyclic azo (thiazole azo, triazole azo, benzothiazole azo) dyes, anthraquinone dyes, and the like can be mentioned. In addition, recently, dispersed cationic dyes obtained by blocking basic groups are also available, and both can be used. Among them, azo dyes are preferable.

In addition, in the cloth dyeing processing, it is preferable to use a carrier agent, and it is possible to employ a dyeing treatment in a bath containing both the cationic dye and the carrier agent. In addition, when the cloth is treated with a special surfactant before the cationic dyeing, deeper dyeing can be achieved by open-width dyeing.

Here, it is preferable that the carrier agent is, for example, at least one member selected from DL-β-ethylphenethyl alcohol, 2-ethoxybenzyl alcohol, 3-chlorobenzyl alcohol, 2,5-dimethylbenzyl alcohol, 2-nitrobenzyl alcohol, p-isopropylbenzyl alcohol, 2-methylphenethyl alcohol, 3-methylphenethyl alcohol, 4-methylphenethyl alcohol, 2-methoxybenzyl alcohol, 3-iodobenzyl alcohol, cinnamic alcohol, p-anisyl alcohol, benzhydrol, and cyclohexylpyrrolidone. The amount of carrier agent is preferably 1 to 10 parts by weight, more preferably 1 to 5 parts by weight, per 100 parts by weight of the meta-type wholly aromatic polyamide fiber.

Thus, the invention is configured as above, and, accordingly, it is possible to obtain a cloth with any color hue, which has excellent protection performance against electric arcs and is resistant to flash fires.

The protective product of the invention is a protective product using the above cloth for protective products, selected from the group consisting of arc protective garments, flame-proof protective garments, work garments, activity garments, gloves, aprons for protection, and members for protection. The work garments include work garments for works in a steel plant or steel factory, work garments for welding, and work garments for use in an explosion-proof area. In addition, the gloves include work gloves used in the aircraft industry, the information equipment industry, the precision machinery industry, and the like where precision components are treated. In such a protective product, it is preferable that the front surface of the cloth is used as the atmosphere side, and the back surface is used as the skin side.

Incidentally, the cloth has not only flame retardancy but also resistance to flash fires (protection force), allowing for improved safety. Incidentally, it is also preferable to stack layers of the cloth. With respect to the resistance to flash fires (protection force) in the case of stacking, with an increase in the number of layers of the cloth stacked like quilting (quilt stitch), the resistance force (protection force) can be improved.

In the cloth, when the constituent yarns, the structure of the cloth, and the like are tailored with ingenuity, and further the arc resistance, breathability, and the like are made within the above ranges, a cloth and a protective product, which have excellent protection performance against electric arcs, can be obtained.

EXAMPLES

Next, examples of the invention and comparative examples will be described in detail, but the invention is not limited thereto. Incidentally, measurement items in the Examples were measured by the following methods.

(1) ATPV Value

The ATPV value was measured in accordance with Arc Resistance Test ASTM F1959-1999. Values of 8 cal/cm$^2$ or more were rated as acceptable (Level 2 cleared).

(2) Cover Factor (CF)

$$CF=(DWp/1.1)^{1/2}\times MWp+(DWf/1.1)^{1/2}\times MWf$$

[DWp is the warp total fineness (dtex), MWp is the warp weaving density (yarns/2.54 cm), DWf is the weft total fineness (dtex), and MWf is the weft weaving density (yarns/2.54 cm).]

(3) Breathability

Breathability was measured in accordance with JIS L1096:2020, A Method (Frazier Method).

(4) Thickness of Woven Fabric

Measurement was performed in accordance with JIS L 1096:2010.

(5) Weight Per Unit of Woven Fabric

Measurement was performed in accordance with JIS L 1096:2010, A Method.

Example 1

For warp, using a meta-type wholly aromatic polyamide fiber ("Teijinconex NEO"® manufactured by Teijin Limited, single fiber fineness: 1.7 dtex, fiber length: 51 mm), a para-type wholly aromatic polyamide fiber ("Twaron" ® manufactured by Teijin Aramid, single fiber fineness: 1.7 dtex, fiber length: 50 mm), and an electrically conductive acrylic fiber (single fiber fineness: 3.3 dtex, fiber: 38 mm, eccentric sheath-core electrically conductive acrylic fiber, sheath part: acrylic/core part: metal compound) serving as an infrared absorber- and electrically conductive agent-containing fiber, a spun yarn of 40/1 cotton count was formed at 23.4 twists/2.54 cm (twist direction: Z) such that the meta-type wholly aromatic polyamide fiber: 80 WT %, the para-type wholly aromatic polyamide fiber: 5 WT %, and the electrically conductive acrylic fiber: 15 WT %, and then, at 23.4 twists/2.54 cm (twist direction: S), a double-ply twisted yarn (A) was obtained.

For weft, using a meta-type wholly aromatic polyamide fiber having kneaded therein 1.1% carbon particles ("Teijinconex" ®) manufactured by Teijin Limited, single fiber fineness: 2.2 dtex, fiber length: 51 mm) and a para-type wholly aromatic polyamide fiber ("Technora" ®) manufactured by Teijin Limited, single fiber fineness: 1.7 dtex, fiber length: 51 mm), a spun yarn of 40/1 cotton count was formed at 23.4 twists/inch (twist direction: Z) such that the meta-type wholly aromatic polyamide fiber: 90 WT % and the para-type wholly aromatic polyamide fiber: 10 WT %, and then, at 23.4 twists/inch (twist direction: S), a double-ply twisted yarn (B) was obtained.

Next, using the double-ply twisted yarn (A) as warp and the double-ply twisted yarn (B) as weft, a woven fabric having a warp density of 72 yarns/2.54 cm and a weft density of 50 yarns/2.54 cm was woven by twill weaving (2/1 twill structure).

The obtained undyed woven fabric (gray fabric) was desized, scoured, and dried in the usual manner, and then, using a jet dyeing machine, dyed in a dye bath containing a cationic dye and a carrier agent for 60 minutes at a temperature of 130° C. raised from ambient. Subsequently, finishing setting was performed, thereby giving a cloth having a carbon content of 0.4 wt %, wherein a spun yarn containing an infrared absorber- and electrically conductive agent-containing fiber was located on the front surface, and a spun yarn containing a carbon-containing fiber was located on the back surface.

In the obtained cloth (arc protective woven fabric), the warp density was 73 yarns/2.54 cm, the weft density was 53 yarns/2.54 cm, the cover factor was 2,054, the thickness was 0.42 mm, the weight per unit was 181 g/m$^2$, and the breathability was 90 cc/cm$^2$·sec. The ATPV value was as excellent as 8.5 cal/cm$^2$. The results are shown in Table 1.

Example 2

For warp, a double-ply twisted yarn (A) was obtained in the same manner as in Example 1. In addition, for weft, using a para-type wholly aromatic polyamide fiber having kneaded therein 5.0% carbon particles ("Technora"® manufactured by Teijin Limited, single fiber fineness: 1.7 dtex, fiber length: 51 mm), a spun yarn of 40/1 cotton count was formed at 23.4 twists/2.54 cm (twist direction: Z), and then, at 23.4 twists/2.54 cm (twist direction: S), a double-ply twisted yarn (B) was obtained.

Using the double-ply twisted yarn (A) as warp and the double-ply twisted yarn (B) as weft, a woven fabric having a warp density of 72 yarns/2.54 cm and a weft density of 50 yarns/2.54 cm was woven by twill weaving (2/1 twill structure).

The obtained undyed woven fabric (gray fabric) was desized, scoured, and dried in the usual manner, and then, using a jet dyeing machine, dyed in a dye bath containing a cationic dye and a carrier agent for 60 minutes at a temperature of 130° C. raised from ambient. Subsequently, finishing setting was performed, thereby giving a cloth having a carbon content of 1.9 wt %, wherein a spun yarn containing an infrared absorber- and electrically conductive agent-containing fiber was located on the front surface, and a spun yarn containing a carbon-containing fiber was located on the back surface.

In the obtained cloth (arc protective woven fabric), the warp density was 73 yarns/2.54 cm, the weft density was 53 yarns/2.54 cm, the cover factor was 2,054, the thickness was 0.42 mm, the weight per unit was 182 g/m$^2$, and the breathability was 88 cc/cm$^2$·sec. The ATPV value was as excellent as 9.3 cal/cm$^2$. The results are shown in Table 1.

Example 3

For warp, a double-ply twisted yarn (A) was obtained in the same manner as in Example 1. In addition, for weft, using a carbon fiber ("Pyromex CPX"® manufactured by Toho Tenax Co., Ltd., single fiber fineness: 2.2 dtex, fiber length: 51 mm), a meta-type wholly aromatic polyamide fiber ("Teijinconex NEO"® manufactured by Teijin Limited, single fiber fineness: 1.7 dtex, fiber length: 51 mm), and a para-type wholly aromatic polyamide fiber ("Twaron" ® manufactured by Teijin Aramid, single fiber fineness: 1.7 dtex, fiber length: 50 mm), a spun yarn of 40/1 cotton count was formed at 23.4 twists/2.54 cm (twist direction: Z) such that the carbon fiber: 50%, the meat-type wholly aromatic polyamide fiber: 45 WT %, and the para-type wholly aromatic polyamide fiber: 5 WT %, and then, at 23.4 twists/2.54 cm (twist direction: S), a double-ply twisted yarn (B) was obtained.

Using the double-ply twisted yarn (A) as warp and the double-ply twisted yarn (B) as weft, a woven fabric having a warp density of 72 yarns/2.54 cm and a weft density of 50 yarns/2.54 cm was woven by twill weaving (2/1 twill structure).

The obtained undyed woven fabric (gray fabric) was desized, scoured, and dried in the usual manner, and then, using a jet dyeing machine, dyed in a dye bath containing a cationic dye and a carrier agent for 60 minutes at a temperature of 130° C. raised from ambient. Subsequently, finishing setting was performed, thereby giving a cloth having a carbon content of 20.1 wt %, wherein a spun yarn containing an infrared absorber- and electrically conductive agent-containing fiber was located on the front surface, and a spun yarn containing a carbon-containing fiber was located on the back surface.

In the obtained cloth (arc protective woven fabric), the warp density was 75 yarns/2.54 cm, the weft density was 53 yarns/2.54 cm, the cover factor was 2,087, the thickness was 0.44 mm, the weight per unit was 185 g/m$^2$, and the breathability was 78 cc/cm$^2$·sec. The ATPV value was as excellent as 9.6 cal/cm$^2$. The results are shown in Table 1.

Example 4

For warp, a double-ply twisted yarn (A) was obtained in the same manner as in Example 1. In addition, for weft, 100 wt % of a para-type wholly aromatic polyamide fiber having kneaded therein 14% carbon particles ("Technora"® manufactured by Teijin Limited, single fiber fineness: 2.8 dtex, fiber length: 51 mm) was formed into a spun yarn of 30/1 cotton count yarn at 20.3 twists/inch (twist direction: Z), and then, at 20.3 twists/inch (twist direction: S), a double-ply twisted yarn (B) was obtained.

Next, using the double-ply twisted yarn (A) as warp and the double-ply twisted yarn (B) as weft, a woven fabric having a warp density of 57 yarns/2.54 cm and a weft density of 43 yarns/2.54 cm was woven by twill weaving (2/1 twill structure).

The obtained undyed woven fabric (gray fabric) was desized, scoured, and dried in the usual manner, and then, using a jet dyeing machine, dyed in a dye bath containing a cationic dye and a carrier agent for 60 minutes at a temperature of 130° C. raised from ambient. Subsequently, finishing setting was performed, thereby giving a cloth having a carbon content of 6.0 wt %, wherein an infrared absorber- and electrically conductive agent-containing spun yarn was located on the front surface, and a spun yarn containing a carbon-containing fiber was located on the back surface.

In the obtained cloth (arc protective woven fabric), the warp density was 57 yarns/2.54 cm, the weft density was 46 yarns/2.54 cm, the cover factor was 1,795, the thickness was 0.46 mm, the weight per unit was 179 g/m$^2$, and the breathability was 94 cc/cm$^2$·sec. The ATPV value was as excellent as 9.2 cal/cm$^2$. The results are shown in Table 1.

Example 5

For weft, a double-ply twisted yarn (A) was obtained in the same manner as in Example 1. For warp, using 100 wt % of a para-type wholly aromatic polyamide fiber having kneaded therein 5.0% carbon particles ("Technora"® manufactured by Teijin Limited, single fiber fineness: 1.7 dtex, fiber length: 51 mm), a spun yarn of 30/1 cotton count was formed at 20.3 twists/2.54 cm (twist direction: Z), and then, at 20.3 twists/2.54 cm (twist direction: S), a double-ply twisted yarn (B) was obtained.

Next, using the double-ply twisted yarn (A) as weft and the double-ply twisted yarn (B) as warp, a woven fabric having a warp density of 65 yarns/2.54 cm and a weft density of 29 yarns/2.54 cm was woven by twill weaving (½ twill structure).

The obtained undyed woven fabric (gray fabric) was desized, scoured, and dried in the usual manner, and then, using a jet dyeing machine, dyed in a dye bath containing a cationic dye and a carrier agent for 60 minutes at a temperature of 130° C. raised from ambient. Subsequently, finishing setting was performed, thereby giving a cloth having a carbon content of 3.5 wt %, wherein an infrared absorber- and electrically conductive agent-containing spun yarn was located on the front surface, and a spun yarn containing a carbon-containing fiber was located on the back surface.

In the obtained cloth (arc protective woven fabric), the warp density was 69 yarns/2.54 cm, the weft density was 30 yarns/2.54 cm, the cover factor was 1,788, the thickness was 0.46 mm, the weight per unit was 178 g/m$^2$, and the breathability was 95 cc/cm$^2$·sec. The ATPV value was as excellent as 8.4 cal/cm$^2$. The results are shown in Table 1.

TABLE 1

| | | | | Example 1 | Example 2 | Example 3 | Example 4 | Example 5 |
|---|---|---|---|---|---|---|---|---|
| Warp | Meta-type wholly aromatic polyamide fiber | Single-yarn fineness | dtex | 1.7 | 1.7 | 1.7 | 1.7 | 1.7 |
| | | Fiber length | mm | 51 | 51 | 51 | 51 | 51 |
| | | | wt % | 80 | 80 | 80 | 80 | 80 |
| | Para-type wholly aromatic polyamide fiber | Single-yarn fineness | dtex | 1.7 | 1.7 | 1.7 | 1.7 | 1.7 |
| | | Fiber length | mm | 51 | 51 | 51 | 51 | 51 |
| | | | wt % | 5 | 5 | 5 | 5 | 5 |
| | Electrically conductive acrylic fiber | Single-yarn fineness | dtex | 3.3 | 3.3 | 3.3 | 3.3 | 3.3 |
| | | Fiber length | mm | 38 | 38 | 38 | 38 | 38 |
| | | | wt % | 15 | 15 | 15 | 15 | 15 |
| | Number of twists Z | Twist direction: Z | twists/2.54 cm | 23.4 | 23.4 | 23.4 | 23.4 | 23.4 |
| | Cotton count | | | 40/1 | 40/1 | 40/1 | 40/1 | 40/1 |
| | Number of twists S | Twist directon: S | twists/2.54 cm | 23.4 | 23.4 | 23.4 | 23.4 | 23.4 |
| Weft | Meta-type wholly aromatic polyamide fiber | Single-yarn fineness | dtex | 1.7 | 1.7 | 1.7 | — | — |
| | | Fiber length | mm | 51 | 51 | 51 | — | — |
| | | Carbon particle content | % | 1.1 | 5 | — | — | — |
| | | | wt % | 90 | 90 | 45 | — | — |

TABLE 1-continued

| | | | | Example 1 | Example 2 | Example 3 | Example 4 | Example 5 |
|---|---|---|---|---|---|---|---|---|
| | Para-type wholly aromatic polyamide fiber | Single-yarn fineness | dtex | 1.7 | 1.7 | 1.7 | 1.7 | 1.7 |
| | | Fiber length | mm | 51 | 51 | 51 | 51 | 51 |
| | | Carbon particle content | % | — | — | — | 14 | 5 |
| | | | wt % | 10 | 10 | 5 | 100 | 100 |
| | Carbon fiber | Single-yarn fineness | dtex | — | — | 2.2 | — | — |
| | | Fiber length | mm | — | — | 51 | — | — |
| | | | wt % | — | — | 50 | — | — |
| | Electrically conductive acrylic fiber | Single-yarn fineness | dtex | — | — | — | — | — |
| | | Fiber length | mm | — | — | — | — | — |
| | | | wt % | — | — | — | — | — |
| | Number of twists Z | Twist direction: Z | twists/2.54 cm | 23.4 | 23.4 | 23.4 | 20.3 | 20.3 |
| | Cotton count | | | 40/1 | 40/1 | 40/1 | 30/1 | 30/1 |
| | Number of twists S | Twist direction: S | twists/2.54 cm | 23.4 | 23.4 | 23.4 | 20.3 | 20.3 |
| Cloth | Cloth form | | | Twill weave (2/1 Twill structure) | Twill weave (2/1 Twill structure) | Twill weave (2/1 Twill structure) | Twill weave (2/1 Twill | Twill weave (1/2 Twill |
| | | structure) | structure) | | | | | |
| | Cloth density before dyeing | Warp density | yarns/2.54 cm | 72 | 72 | 72 | 57 | 65 |
| | | Weft density | yarns/2.54 cm | 50 | 50 | 50 | 43 | 29 |
| | Cloth density after dyeing | Warp density | yarns/2.54 cm | 73 | 73 | 75 | 57 | 69 |
| | | Weft density | yarns/2.54 cm | 53 | 53 | 53 | 46 | 30 |
| | Carbon content | | % | 0.4 | 1.9 | 20.1 | 6.0 | 3.5 |
| | Cover factor | | | 2054 | 2054 | 2087 | 1795 | 1788 |
| | Thickness | | mm | 0.42 | 0.42 | 0.44 | 0.46 | 0.46 |
| | Weight per unit | | $g/m^2$ | 181 | 182 | 185 | 179 | 178 |
| | Breathability | | $cc/cm^2 \cdot sec$ | 90 | 88 | 78 | 94 | 95 |
| | ATPV value | | $cal/cm^2$ | 8.5 | 9.3 | 9.6 | 9.2 | 8.4 |

Comparative Example 1

Using a meta-type wholly aromatic polyamide fiber ("Teijinconex NEO"® manufactured by Teijin Limited, single fiber fineness: 1.7 dtex, fiber length: 51 mm), a para-type wholly aromatic polyamide fiber ("Twaron"® manufactured by Teijin Aramid, single fiber fineness: 1.7 dtex, fiber length: 50 mm), and an electrically conductive acrylic fiber (single fiber fineness: 3.3 dtex, fiber length: 38 mm) serving as an electrically conductive fiber, a spun yarn of 30/1 cotton count was formed at 20.3 twists/2.54 cm (twist direction: Z) such that the meta-type wholly aromatic polyamide fiber: 85 WT %, the para-type wholly aromatic polyamide fiber: 5 WT %, and the electrically conductive acrylic fiber: 10 WT %, and then, at 20.3 twists/2.54 cm (twist direction: S), a double-ply twisted yarn was obtained.

Next, using the double-ply twisted yarn as warp and weft, a woven fabric having a warp density of 54 yarns/2.54 cm and a weft density of 39 yarns/2.54 cm was woven by twill weaving (2/2 twill structure).

The obtained undyed woven fabric (gray fabric) was desized, scoured, and dried in the usual manner, and then, using a jet dyeing machine, dyed in a dye bath containing a cationic dye and a carrier agent for 60 minutes at a temperature of 130° C. raised from ambient, followed by finishing setting.

In the obtained arc protective woven fabric, the warp density was 57 yarns/2.54 cm, the weft density was 41 yarns/2.54 cm, the cover factor was 1,845, the thickness was 0.48 mm, the weight per unit was 182 $g/m^2$, and the breathability was 152.2 $cc/cm^2 \cdot sec$. The ATPV value was as poor as 6.7 $cal/cm^2$. The results are shown in Table 2.

Comparative Example 2

For warp, using a meta-type wholly aromatic polyamide fiber ("Teijinconex NEO"® manufactured by Teijin Limited, single fiber fineness: 1.7 dtex, fiber length: 51 mm) and a para-type wholly aromatic polyamide fiber ("Twaron"® manufactured by Teijin Aramid, single fiber fineness: 1.7 dtex, fiber length: 50 mm), a spun yarn of 40/1 cotton count was formed at 23.4 twists/inch (twist direction: Z) such that the meta-type wholly aromatic polyamide fiber: 95 WT % and the para-type wholly aromatic polyamide fiber: 5 WT %, and then, at 23.4 twists/inch (twist direction: S), a double-ply twisted yarn (A) was obtained.

For weft, a double-ply twisted yarn (B) was obtained in the same manner as in Example 1. Using the double-ply twisted yarn (A) as warp and the double-ply twisted yarn (B) as weft, a woven fabric having a warp density of 72 yarns/2.54 cm and a weft density of 50 yarns/2.54 cm was woven by twill weaving (2/1 twill structure).

The obtained undyed woven fabric (gray fabric) was desized, scoured, and dried in the usual manner, and then, using a jet dyeing machine, dyed in a dye bath containing a cationic dye and a carrier agent for 60 minutes at a temperature of 130° C. raised from ambient. Subsequently, finishing setting was performed, thereby giving a cloth having a carbon content of 0.4 wt %, wherein a spun yarn containing an infrared absorber- and electrically conductive agent-containing fiber was located on the front surface, and a spun yarn containing a carbon-containing fiber was located on the back surface.

In the obtained cloth (arc protective woven fabric), the warp density was 76 yarns/2.54 cm, the weft density was 53 yarns/2.54 cm, the cover factor was 2,103, the thickness was 0.44 mm, the weight per unit was 183 $g/m^2$, and the breathability was 75 $cc/cm^2 \cdot sec$. The ATPV value was as poor as 7.6 $cal/cm^2$. The results are shown in Table 2.

Comparative Example 3

For warp, a double-ply twisted yarn (A) was obtained in the same manner as in Example 1. In addition, for weft, a double-ply twisted yarn (B) having the same configuration as the double-ply twisted yarn (A) for warp was obtained.

Next, using the double-ply twisted yarn (A) as warp and the double-ply twisted yarn (B) as weft, a woven fabric having a warp density of 72 yarns/2.54 cm and a weft density of 50 yarns/2.54 cm was woven by twill weaving (2/1 twill structure).

The obtained undyed woven fabric (gray fabric) was desized, scoured, and dried in the usual manner, and then, using a jet dyeing machine, dyed in a dye bath containing a cationic dye and a carrier agent for 60 minutes at a temperature of 130° C. raised from ambient, followed by finishing setting.

In the obtained cloth (arc protective woven fabric), the warp density was 76 yarns/2.54 cm, the weft density was 53 yarns/2.54 cm, the cover factor was 2,103, the thickness was 0.44 mm, the weight per unit was 183 g/m$^2$, and the breathability was 78 cc/cm$^2$·sec. The ATPV value was as poor as 6.1 cal/cm$^2$. The results are shown in Table 2.

Comparative Example 4

For warp, a double-ply twisted yarn (A) was obtained in the same manner as in Example 1. For weft, 100 wt % of a para-type wholly aromatic polyamide fiber having kneaded therein 4.0% carbon particles ("Technora"® manufactured by Teijin Limited, single fiber fineness: 1.7 dtex, fiber length: 51 mm) was formed into a spun yarn of 30/1 cotton count at 20.3 twists/inch (twist direction: Z), and then, at 20.3 twists/inch (twist direction: S), a double-ply twisted yarn (B) was obtained.

Next, using the double-ply twisted yarn (A) as warp and the double-ply twisted yarn (B) as weft, a woven fabric having a warp density of 57 yarns/2.54 cm and a weft density of 43 yarns/2.54 cm was woven by twill weaving (2/1 twill structure).

The obtained undyed woven fabric (gray fabric) was desized, scoured, and dried in the usual manner, and then, using a jet dyeing machine, dyed in a dye bath containing a cationic dye and a carrier agent for 60 minutes at a temperature of 130° C. raised from ambient. Subsequently, finishing setting was performed, thereby giving a cloth having a carbon content of 2.3 wt %, wherein an infrared absorber- and electrically conductive agent-containing spun yarn was located on the front surface, and a spun yarn containing a carbon-containing fiber was located on the back surface.

In the obtained cloth (arc protective woven fabric), the warp density was 57 yarns/2.54 cm, the weft density was 46 yarns/2.54 cm, the cover factor was 1,795, the thickness was 0.45 mm, the weight per unit was 178 g/m$^2$, and the breathability was 130 cc/cm$^2$·sec. The ATPV value was as poor as 7.4 cal/cm$^2$. The results are shown in Table 2.

TABLE 2

| | | | | Comparative Example 1 | Comparative Example 2 | Comparative Example 3 | Comparative Example 4 |
|---|---|---|---|---|---|---|---|
| Warp | Meta-type wholly aromatic polyamide fiber | Single-yarn fineness | dtex | 1.7 | 1.7 | 1.7 | 1.7 |
| | | Fiber length | mm | 51 | 51 | 51 | 51 |
| | | | wt % | 85 | 95 | 80 | 80 |
| | Para-type wholly aromatic polyamide fiber | Single-yarn fineness | dtex | 1.7 | 1.7 | 1.7 | 1.7 |
| | | Fiber length | mm | 51 | 50 | 51 | 51 |
| | | | wt % | 5 | 5 | 5 | 5 |
| | Electrically conductive acrylic fiber | Single-yarn fineness | dtex | 3.3 | — | 3.3 | 3.3 |
| | | Fiber length | mm | 38 | — | 38 | 38 |
| | | | wt % | 10 | — | 15 | 15 |
| | Number of twists Z | Twist direction: Z | twists/2.54 cm | 20.3 | 23.4 | 23.4 | 23.4 |
| | Cotton count | | | 30/1 | 40/1 | 40/1 | 40/1 |
| | Number of twists S | Twist direction: S | twists/2.54 cm | 20.3 | 23.4 | 23.4 | 23.4 |
| Weft | Meta-type wholly aromatic polyamide fiber | Single-yarn fineness | dtex | 1.7 | 1.7 | 1.7 | — |
| | | Fiber length | mm | 51 | 51 | 51 | — |
| | | Carbon particle content | % | — | 1.1 | — | — |
| | | | wt % | 85 | 90 | 80 | — |
| | Para-type wholly aromatic polyamide fiber | Single-yarn fineness | dtex | 1.7 | 1.7 | 1.7 | 1.7 |
| | | Fiber length | mm | 51 | 51 | 51 | 51 |
| | | Carbon particle content | % | — | — | — | 4 |
| | | | wt % | 5 | 10 | 5 | 100 |
| | Carbon fiber | Single-yarn fineness | dtex | — | — | — | — |
| | | Fiber length | mm | — | — | — | — |
| | | | wt % | — | — | — | — |
| | Electrically conductive acrylic fiber | Single-yarn fineness | dtex | 3.3 | — | 3.3 | — |
| | | Fiber length | mm | 38 | — | 38 | — |
| | | | wt % | 10 | — | 15 | — |
| | Number of twists Z | Twist direction: Z | twists/2.54 cm | 20.3 | 23.4 | 23.4 | 20.3 |
| | Cotton count | | | 30/1 | 40/1 | 40/1 | 30/1 |
| | Number of twists S | Twist direction: S | twists/2.54 cm | 20.3 | 23.4 | 23.4 | 20.3 |
| Cloth | Cloth form | | | Twill weave (2/2 Twill structure) | Twill weave (2/1 Twill structure) | Twill weave (2/1 Twill structure) | Twill weave (2/1 Twill structure) |
| | Cloth density before dyeing | Warp density | yarns/2.54 cm | 54 | 72 | 72 | 57 |
| | | Weft density | yarns/2.54 cm | 39 | 50 | 50 | 43 |
| | Cloth density after dyeing | Warp density | yarns/2.54 cm | 57 | 76 | 76 | 57 |
| | | Weft density | yarns/2.54 cm | 41 | 53 | 53 | 46 |
| | Carbon content | | % | 0 | 0.4 | 0 | 2.3 |
| | Cover factor | | | 1845 | 2103 | 2103 | 1795 |
| | Thickness | | mm | 0.48 | 0.44 | 0.44 | 0.45 |
| | Weight per unit | | g/m$^2$ | 182 | 183 | 183 | 178 |
| | Breathability | | cc/cm$^2$ · sec | 152.2 | 75 | 78 | 130 |
| | ATPV value | | cal/cm$^2$ | 6.7 | 7.6 | 6.1 | 7.4 |

The invention claimed is:

1. A cloth comprising a woven fabric structure, characterized in that a front-surface spun yarn containing an infrared absorber- and/or electrically conductive agent-containing fiber and not containing carbon is located on a front surface, while a back-surface spun yarn containing a carbon-containing fiber is located on a back surface, and the cloth has an ATPV value of 8.0 cal/cm$^2$ or more in Arc Resistance Test ASTM F1959-1999, and the front-surface spun yarn is a spun yarn containing a meta-type wholly aromatic polyamide fiber in an amount of 30 to 95 wt %, a para-type wholly aromatic polyamide fiber in an amount of 3 to 40 wt %, and an infrared absorber- and/or electrically conductive agent-containing fiber in an amount of 2 to 30 wt %, and the infrared absorber- and/or electrically conductive agent-containing fiber is a sheath-core conjugate fiber, or an eccentric sheath-core conjugate fiber, in which the sheath is made of acrylic, and the core is made of a polymer containing metal oxide-based particles, and the front-surface spun yarn contains an aromatic polyamide fiber, and the aromatic polyamide fiber and the infrared absorber- and/or electrically conductive agent-containing fiber contain the same dye in each fiber, and the exposure of the back-surface spun yarn on the front surface of the cloth is smaller than the exposure of the front-surface spun yarn on the front surface of the cloth, and the back-surface spun yarn contains carbon in an amount of 0.5 to 50 wt % based on the spun yarn weight, and carbon is contained in an amount of more than 3.0 wt % based on the cloth weight, and the cloth has a breathability specified in JIS L 1096:2010, A Method (Frazier Method), of 10 to 100 cc/cm$^2$ sec, and the cloth has a cover factor (CF) defined by the following formula of 1,700 to 3,500:

$$CF=(DWp/1.1)^{1/2}\times MWp+(DWf/1.1)^{1/2}\times MWf$$

[DWp is the warp total fineness (dtex), MWp is the warp weaving density (yarns/2.54 cm), DWf is the weft total fineness (dtex), and MWf is the weft weaving density (yarns/2.54 cm)], and the weight per unit of the cloth specified in JIS L 1096:2010, A Method, is 120 to 260 g/m$^2$, and the thickness of the cloth specified in JIS L 1096:2010 is 0.4 to 0.8 mm, and the cloth has 2/1 twill structure.

2. The cloth according to claim 1, wherein the back-surface spun yarn includes a carbon-containing meta-type wholly aromatic polyamide fiber and/or para-type wholly aromatic polyamide fiber.

3. The cloth according to claim 1, wherein the front-surface spun yarn contains the infrared absorber-containing fiber in an amount of 10 to 30 wt %.

4. The cloth according to claim 1, wherein the front-surface spun yarn contains the electrically conductive agent-containing fiber in an amount of 2 to 20 wt %.

5. A protective product comprising the cloth according to claim 1 and selected from the group consisting of arc protective garments, flame-proof protective garments, work garments, activity garments, gloves, aprons for protection, and members for protection.

* * * * *